US006302094B1

(12) United States Patent
Wehrly et al.

(10) Patent No.: US 6,302,094 B1
(45) Date of Patent: Oct. 16, 2001

(54) INDOOR/OUTDOOR HEATING AND COOLING SYSTEM

(76) Inventors: John D. Wehrly; Agnes A. Wehrly, both of 505 Lewis La. #11, Pacifica, CA (US) 94044

( * ) Notice: Subject to any disclaimer, the term of this patent is extended or adjusted under 35 U.S.C. 154(b) by 0 days.

(21) Appl. No.: 09/588,860

(22) Filed: Jun. 6, 2000

Related U.S. Application Data

(60) Provisional application No. 60/147,806, filed on Aug. 9, 1999.

(51) Int. Cl.[7] ..... F24H 1/00

(52) U.S. Cl. ..... 126/5; 126/59; 126/204; 62/259.3; 62/261; 62/434; 135/92; 4/598; 297/180.15

(58) Field of Search ..... 126/5, 59, 204, 126/205, 344, 367.1; 165/46; 62/261, 259.3, 434; 4/598, 602, 603; 135/92; 297/180.15

(56) References Cited

U.S. PATENT DOCUMENTS 2,989,959 * 6/1961 Bryden ..... 126/344
3,431,565 * 3/1969 Nelson ..... 4/598
4,996,970 * 3/1991 Legare ..... 126/204
5,165,127 * 11/1992 Nicholson ..... 62/261
5,417,201 * 5/1995 Thomas et al. ..... 126/344
5,878,928 * 3/1999 Seiber ..... 4/602

FOREIGN PATENT DOCUMENTS

54102 * 7/1934 (NO) ..... 4/598

* cited by examiner

*Primary Examiner*—Sara Clarke

(57) ABSTRACT

A heat exchanging coil is immersed in water in a heating pod heated over a fire or other heat source. Flexible tubing connected to the coil transmits heated water or other fluid under pressure from a water pump in a reservoir connected to the tubing. Loops of the tubing pass through various items used in outdoor activity including sleeping bags, tents, heaters, bowls, chairs, and even a shower. The heated water is pumped intermittently in a continuously recirculating flow through the system from the heating coil through the item(s) and back again through the heating coil. A timer connected to the pump allows flow of the heated water bolus at any desired timed interval. Alternately, cold water may be circulated through the system for cooling in conditions of extreme heat. Ice or snow or cold water may be used in the heating pod and the pump activated to circulate the chilled water.

20 Claims, 3 Drawing Sheets

INDOOR/OUTDOOR HEATING AND COOLING SYSTEM

CLAIM OF PROVISIONAL APPLICATION RIGHTS

This application claims the benefit of U.S. Provisional Patent Application No. 60/147,806, filed on Aug. 9, 1999.

BACKGROUND OF THE INVENTION

1. Field of the Invention

The present invention relates to heating and cooling devices and in particular to an outdoor system for heating or cooling water in a coil and circulating the heated or cooled water through camping and outdoor survival apparatus and equipment, such as sleeping bags, tents, chairs, cooking utensils, emergency outdoor surgery table, and showers.

2. Description of the Prior Art

People have always sought an economical and efficient way to provide heat both indoors and outdoors.

In outdoor activity, such as camping, hiking, mountain climbing, skiing, hunting, or other outdoor recreation and in outdoor survival situations, such as people being stranded outdoors as a result of a vehicle breakdown or accident or plane crash, survival is threatened in conditions of extreme cold or extreme heat. Rapidly lowered body temperature in extreme cold and rapidly elevated body temperature in extreme heat can be life threatening conditions.

Even in conditions of moderate cold or heat, comfort provided by appropriate heating or cooling to moderate the temperature makes outdoor activity far more enjoyable, especially for sleeping outdoors at night. In addition creature comforts, such as a hot shower on a camping or hiking expedition or other extended outdoor activity makes a civilized and hygienically healthy addition to roughing it in the wilds.

Indoor heating systems have been brought to a high degree of efficiency, but when power outages occur from storms, earthquakes, and other natural or any man-made disasters, most indoor heating systems shut off because the temperature controls rely on electricity for their operation. Usually this shut down occurs during storms, which may produce high winds, snow, and ice to break power lines. Often the temperature is low. Efficient and inexpensive back-up heating systems would provide comfort under such circumstances and would save lives under conditions of extreme cold when the indoor heating system fails.

In extremely hot weather, when power outages occur often due to power drains from air conditioners, efficient and inexpensive back-up cooling systems would provide comfort and save lives by preventing heat strokes.

Prior art attempts at solving these problems have focused primarily on providing heat in cold conditions.

U.S. Pat. No. 4,996,970 issued to Legare provides a heated sleeping bag ground pad using a flat heat reservoir which incorporates a shallow container of water with a metal bottom and pipes leading into and out of it and a top plastic cover housing a plastic water pump. The Legare device would not allow heating directly over an open fire because of the danger of melting the plastic top and pump. It appears that only a small amount of heat could be provided by the Legare device. The heat would only be supplied to a ground pad located close to the heating reservoir. Because it cannot be placed directly in a camp fire, but sits next to the fire, in time the apparatus will loose contact with the heat source rendering it ineffective. Legare provides a small reservoir of water which would soon evaporate. The thermal switch provided in the Legare patent is complex and subject to failure as a result, particularly under the rugged conditions of outdoor activities.

U.S. Design Pat. No. Des. 382,090 issued to Pruett, shows an electrically heated sleeping bag with an element that appears to plug into a cigarette lighter of a vehicle or other electrical source. This device is limited to use with a vehicle or in proximity to some source of electricity.

U.S. Pat. No. 5,528,779 issued to Lee et al, describes an air-cushioned sleeping bag which incorporates a heating pad which must be plugged into an electric outlet, with limitation of use to the close proximity of an electrical outlet.

U.S. Pat. No. 4,825,868 issued to Susa et al, provides a far infrared ray radiating mattress for heating the human body. It requires an electrical outlet as a power source.

None of the prior art devices provide an outdoor system that can be used both for heating and cooling.

None of the prior art devices provide an outdoor heating system with a heating unit that can be placed directly in the fire to produce a substantial amount of heat that can be circulated to devices a substantial distance from the fire and through a number of outdoor devices, including sleeping bags, tents, showers, heaters, emergency outdoor surgery tables, and cooking utensils.

None of the prior art devices having a heating unit that can remain in the fire for the life of the fire to produce heat for a prolonged amount of time.

SUMMARY OF THE INVENTION

One object of the present invention is to provide a simple inexpensive system that can produce heat efficiently and require only the system, a fire or other source of heat, and water.

A further object of the present invention is to provide a lightweight and relatively compact heating and cooling system that can be drained of all fluid and is easily stored in a backpack and transported by people on foot outdoors. The dry system, including batteries weighs less than twelve pounds.

An additional object of the present invention is to provide a coil in water heating unit that can be placed directly on a fire for maximum production of heat, or alternately, immersed in cold water or snow or ice with a pump to circulate the fluid in the coil to heat or cool the other elements of the system, such as a sleeping bag, a tent, a heater, furniture, bowls, a shower, or other devices.

A corollary object of the present invention is to provide a system in which the coil may be placed directly in the fire without being immersed in water, or the coil may be used effectively in the container even if the water has boiled away leaving the coil exposed to the air inside the container.

Another object of the present invention is to provide a heating unit with a broad flat base enabling the unit to remain in a wood fire until all of the wood burns down.

A further object of the present invention is to provide a funnel-like nonflammable container positioned over the heating pod, the funnel-like container having a top reservoir filled with snow or ice and a bottom hollow stem portion inserted in a top opening in the heating pod. The snow or ice melts from the heat above the heating pod and provides a source of water for the heating pod, especially important when no water is available, but there is plenty of snow or ice.

One more object of the present invention is to provide a heating system with a circulating pump positioned away from the heating unit, enabling the pump to be fabricated of lightweight material, which may be a flammable plastic, for ease of transportation by people on foot outdoors.

Yet another object of the present invention is to provide a timer with variable settings to control the pump for distributing the fluid as desired at intervals to save on the life of the battery.

One more object of the present invention is to provide a loop of tubing positioned inside each of the items to be heated or cooled, wherein the loop is curled around inside each of the items to form more surface area contacting each of the items and to create turbulent flow inside the tubing to slow the flow for longer heat exchange between the tubing and each of the items.

Still another object of the present invention is to provide a system which can be either a heating or a cooling system by immersing the coil of the system in hot water or cold water, ice, or snow as desired to meet the prevailing conditions and provide comfort and life saving temperatures for individuals involved in outdoor activity.

A further object of the present invention is to provide an emergency back-up heating and cooling system for the home during power outages to provide heating in conditions of extreme cold and cooling in conditions of extreme heat.

In brief, a heat exchanging coil with water circulated through it is immersed in a container of either hot or cold water or ice or snow or other fluid of a desired temperature. For heating the container is placed over a fire or other heating source to heat the water in the container. A pump in a reservoir of water or other fluid pumps that fluid through flexible tubing and through the coil in a continuous cycle at intermittent time intervals according to the heating or cooling requirement. The tubing is inserted in loops within various outdoor items, such as sleeping bags, tents, heaters, bowls, chairs, tables, and other items normally used outdoors either for heating or cooling the item(s) as desired.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
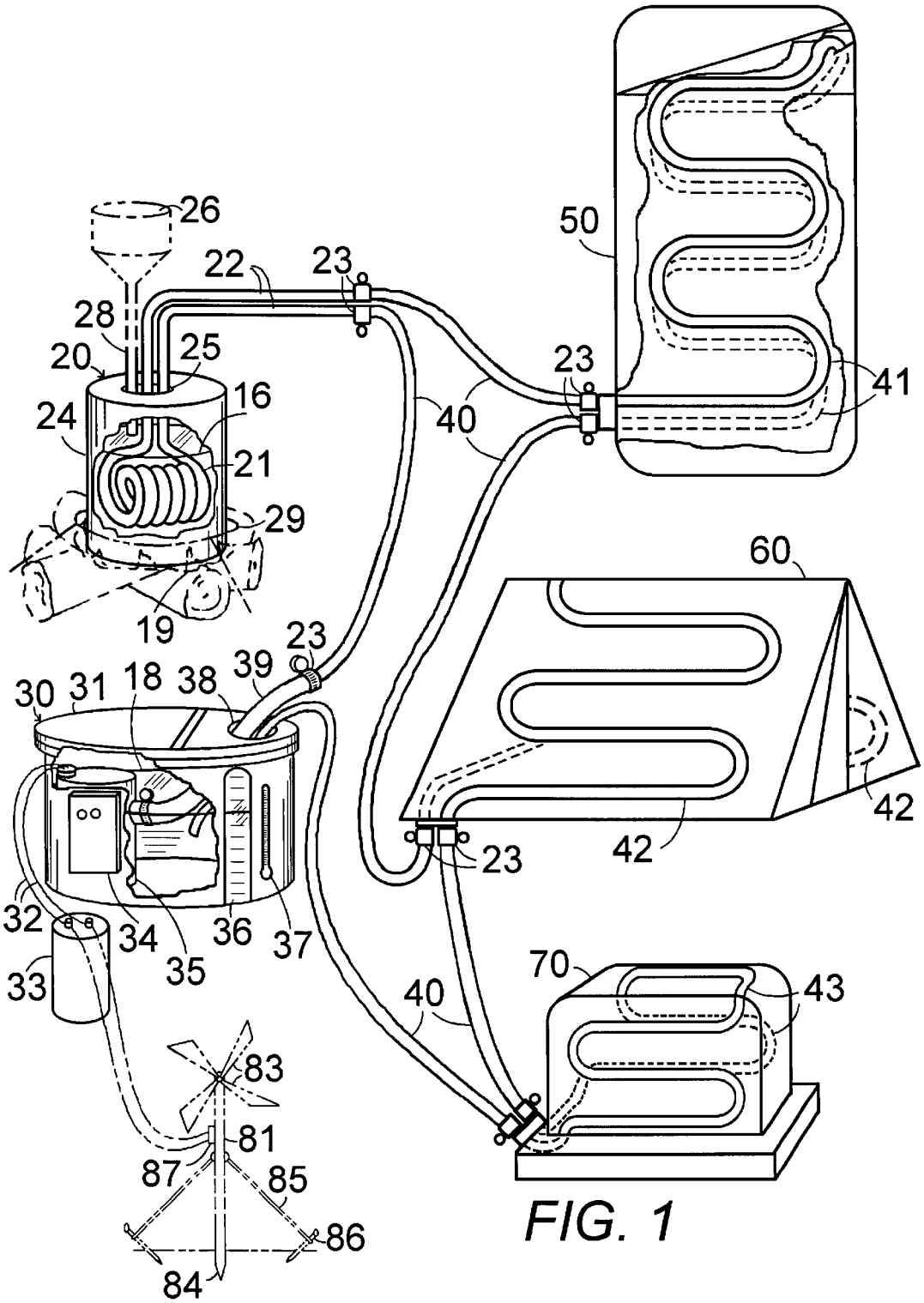
FIG. 1 is a schematic view providing an over view of the entire apparatus including a heating pod (shown resting in a log fire), a reservoir and water pump apparatus, tubing to all parts of the system which includes, but is not limited to a sleeping bag, tent, and heater, and a pump battery and back-up wind-powered generator for power.
Figure 2:
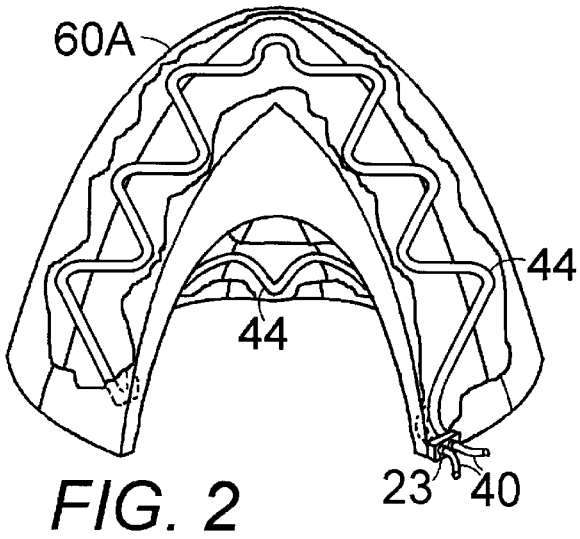
FIG. 2 is a perspective view of an alternate form of tent structure supplied with the loop of tubing for circulating heated or cooled fluid therethrough.

In FIG. 1 the invention comprises an outdoor heating system for taking heat from a heat source and distributing the heat to a variety of items normally used outdoors. The main elements of the system comprise a heating pod 20 placed on a heat source 19 such as a log fire, with a heat exchanging coil 21 immersed in water or other fluid 16 for heating water or other fluid in the coil, flexible tubing 40, 41, 42, 43 for distributing the heated water through various items normally used in outdoor activity, and a pump 35 in a reservoir 30 containing a second fluid 18, preferably water, for circulating the water in the tubing. A timer 34 may be used to control the pump 35 and a thermometer 37 for measuring the temperature of the water. A clear calibrated window 36 or other calibrated means may be used to monitor the water level in the water reservoir 30.

The heat pod 20 has a heating container 24 capable of absorbing heat and capable of holding a first fluid 16, such as water, therein and a heat exchange means, such as coil 21 within the heating container, the heat exchange means capable of being immersed in the first fluid to absorb heat from the first fluid. The heat exchange means has an interior opening therethrough capable of having a second fluid flow, also preferably water, through the interior opening, the second fluid capable of absorbing heat from the heat exchange means. The heating container 24 has a broad flat bottom for resting on an outdoor campfire 19. A stand 29 for the heating container 24, may be used. The stand 29 is capable of supporting the heating container 24 directly over the campfire 19 and capable of positioning the heating container 24 in contact with the heat from the campfire as the campfire burns down by allowing the container 24 to slip downwards as the fire burns down, while maintaining the heating container 24 in an upright position.

The heart of the system is the pod unit 20. The pod shell (container 24) is made of a heat resistant, lightweight material. Metal alloys such as aluminum, stainless steel, enamel on steel, porcelain on steel, iron, ceramic or asbestos can be used. Since the pod is the heaviest piece of the apparatus, it can be scaled down and made lighter to accommodate hikers, mountain climbers, soldiers, etc.

The pod unit can be of any practical size and volume taking into consideration water being boiled off and the amount of metal coils inside. You can even produce good results with a smaller size, such as a 1.5 gallon aluminum alloy pod. Water will be inside the pod, but the coils should be submersed in water. The opening 25 at the top may be of variable size and will serve to ventilate water (steam) vapors and serve as a portal for the metal tubing ends 22 of the coil 21. The metal tubing comes out of the top of the pod and inside the pod can be of any variable length and is preferably coiled to increase surface area and maximize heat transfer. The coils can be of any size, length within the pod but are preferably submerged under the water, such as 2" copper coils with a diameter of 0.5 cm. The coils should be kept under the water for best results and the pod shouldn't run dry although it will still function well dry. The water in the heating pod heats more uniformly and acts as a buffer in heating the coil. Additionally, the opening 25 may receive an optional funnel-like nonflammable container (shown dashed in FIG. 1) having an upper reservoir 26 filled with snow or ice and a lower hollow stem 28 inserted in the top opening 25 in the heating pod. The snow or ice melts from the heat above the heating pod and provides a source of water for the heating pod.

A conduit means, such as flexible tubing 40, 41, 42, 43 is capable of receiving the second fluid from the heat exchange means and distributing the second fluid through at least one of the items, which may include a sleeping bag 50, a tent 60, a heater 70 and any other outdoor item(s) which would be improved by heating, to transmit heat to the item(s), and recirculate the second fluid back through the heat exchange means in a continuous cycle of heating and distributing the second fluid at timed intervals controlled by the timer. A loop of tubing 41–47 is positioned inside each of the items to be heated or cooled, wherein the loop is curled around inside each of the items to form more surface area contacting each of the items and to create turbulent flow inside the tubing to slow the flow for longer heat exchange between the tubing and each of the items.

The tubing extends to all parts of the invention and is similar to a circulatory system. The initial stretch of tubing can be more heat resistant than the other parts of the tubing to accommodate near steam-boiling pressures of water from the pod. The tubing is preferably lightweight, inexpensive, plastic polymer, rubber, neoprene or any other practical material. It can be of any diameter, such as ⅜" polyvinyl plastic. Although the length and diameter of the tubing can vary, factory made units will have a prescribed length and diameter.

Because of the direct placement of the heating pod over the fire considerable heat is produced so the tubing can run for a considerable distance and distribute substantial amounts of heat to many different items used outdoors. In an experimental mode 20" segments were used from the heating pod to the heated items and from heated items 15' to the water pump and 5' from the water pump to the heating pod.

Figure 3:
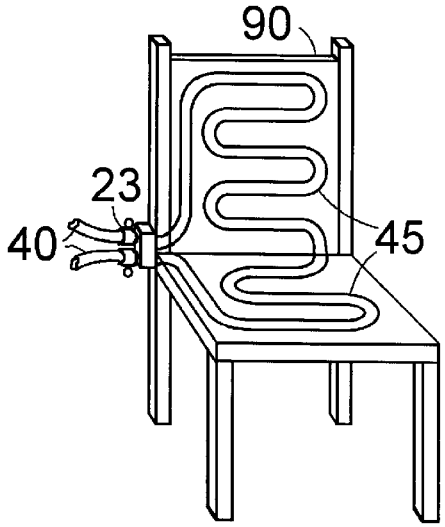
FIG. 3 is a perspective view of a chair having the loop of tubing incorporated in the structure for circulating heated or cooled fluid therethrough.

The tubing is connected to all elements by water hose clamps 23. The tubing is pliable, non-breakable and it gives sufficient heat transfer. The tubing can take on a more turbulent flow in the heated element to transfer more heat. The tubing is sewn into the apparatus to be heated, in this case (FIG. 1) a sleeping bag 50, a tent 60 and 60A, a portable heater 70, a portable chair 90 (FIG. 3). In the heated element, the tubing can take on different lengths, directions (vertical, horizontal), and diameter. A lightweight material of good heat insulation can be placed around tubing to retain and conserve heat and is optional.

The pump 35 is capable of pumping the second fluid through the conduit means, flexible tubing 40, 41, 42, 43 and the heat exchange means, coil 21. The coil 21 has a hollow interior throughout the length of the coil and preferably is fabricated of a noncombustible rigid material capable of transferring heat to the fluid flowing through the coil, the coil having at least one outflow elongated end and at least one inflow elongated end, which may be alternated by reversing the flow direction. The elongated ends 22 protruding out through an opening 25 and extending beyond the heat source to prevent contact of the direct heat with the flexible tubing 40 connected to the ends. The opening 25 in the heating container 24 also allows venting of the steam from the heated water 16 inside.

The conduit means comprises a flexible tube 40 attached to the outflow end of the heat transfer means and extending through the outdoor item(s) 50,60,70 and attached to which will change their physical properties. Polyvinyl tubing is pliable, lightweight and non-breakable. It will retain and transfer heat well. Presented are some materials used and their characteristics. the inflow end of the heat transfer means, coil 21. The flexible tubing 40 also communicates with the pump 35, so that the flexible tubing forms, with the interior opening of the heat exchange means, a continuous loop for circulating the second fluid therethrough, the second fluid being circulated by the pump 35. The flexible tubing 40 is capable of being inserted in a number of the outdoor items by inserting a loop of the flexible tubing 41, 42, 43 into each of the items. A loop of tubing is positioned inside each of the items to be heated or cooled, wherein the loop is curled around inside each of the items to form more surface area contacting each of the items and to create turbulent flow inside the tubing to slow the flow for longer heat exchange between the tubing and each of the items.

The flexible tubing 41, 42, 43 may be built into the outdoor item(s) 50, 60, 70 forming a loop therein, the loop having two ends each attached to a clamp 23, the clamp 23 being capable of clamping an end of an exterior flexible tubing 40.

The pump 35 rests in a fluid storage container 30, or reservoir containing the second fluid 18, the pump being capable of pumping the second fluid through the system.

A timer 34 may be used to control the pump 35 to regulate the flow as desired. The pump 35 is a lightweight pump formed of synthetic material and powered by a battery 33 connected by wires 32 to the pump 35. A wind powered generator 87 may be used for generating electricity to power the battery 33 and run the pump 35 for unlimited power. The wind powered generator 87 is mounted on a post 81 with a pointed bottom end 84 for insertion in the ground with tie-down ropes 85 and stakes 86 to secure it and wind turbine blades 83 to run the generator 87.

The water pump 35 in the reservoir 30 can be a submersible centrifugal pump type or impeller, screw or any other water pump type in line of reservoir type. This invention includes not only all types of pumps, but also all voltages of pumps. The system can use any type of water pump, bilge pump, sump pump or any other whether the pump is submersible or nonsubmersible, inline, centrifugal, diaphragm, or piston. This is inclusive of all pumps not mentioned here. Centrifugal is the best because it can adequately move (transfer) water there by heat.

Preferably, the reservoir and water pump should be lightweight made of any such material. All system components are drained of water while traveling or not in use, and the system is primed completely with water before use.

The timer should be of low voltage requirement and lightweight. The timer can be spring powered (dial), AC or DC power. The IC timer circuit is adjustable via dials or toggle mounted on the timer unit, which can be set manually. A remote control may be used from the tent to increase/decrease desired heat by remotely adjusting the timer.

In the experimental model, a rechargeable 12V battery was used attached to the timer unit and water pump. The power source can also be wind power with lightweight attachments, solar power, or hydroelectric power. The battery can be attached to the lightweight windmill or power can be generated directly from the windmill. The power system and voltage can be of any size 6V, 12V, 24V: not exclusive to these voltages but all others and AC power.

In FIG. 1 the outdoor items which are heated consist of a sleeping bag 50 having a loop of tubing 41 which may be on the top and bottom of the sleeping bag, a triangular tent 60 having a loop of flexible tubing 42, and a heater 70 having a loop of flexible tubing 43.

The sleeping bag, tent, heater, chair or item to be heated can be of any material size. Common features will include; an in/out take port at clamps 23 in some accessible location. The tubing will be sewn inside the heated item. A layer of insulation will preferably be positioned between the tubing and individual(s) to be heated to avoid being burned.

In FIGS. 2–6 additional outdoor items include a circular tent 60 A with a loop of flexible tubing 44, a chair 90 with a loop of flexible tubing 45, a bowl 100 with a loop of flexible tubing 46, and an outdoor operating table 110 with a loop of flexible tubing 47 therein for military and emergency field use to warm patients.

Figure 7:
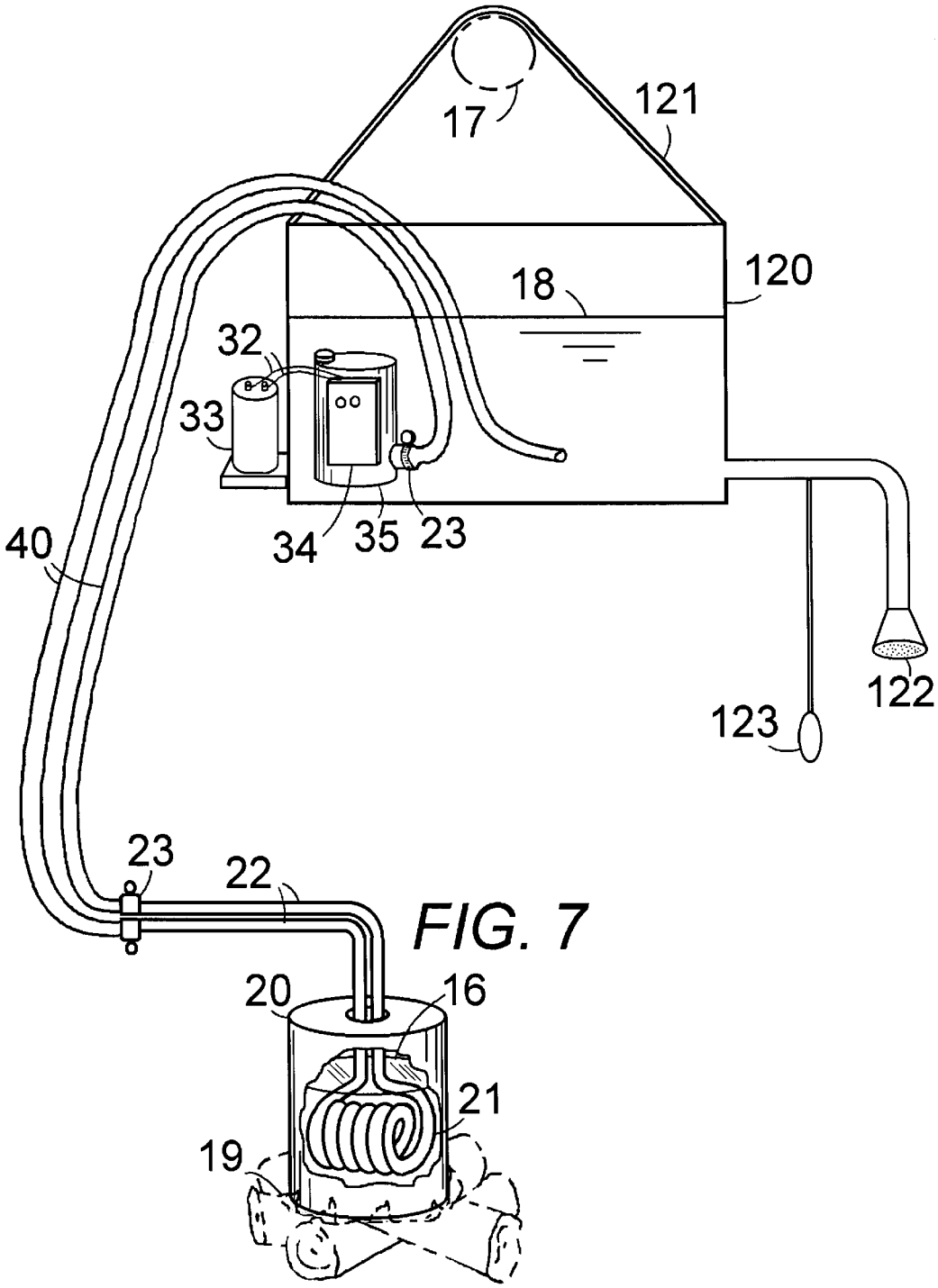
FIG. 7 is a perspective view of an alternate embodiment of the invention showing the heating pod resting an a log fire with an input and an output section of tubing, each terminating in a reservoir having a pump connected to a shower head.

In FIG. 7 an alternate embodiment of the fluid storage container 120 further comprises a shower spout 122, having a pull activated cord 123, attached to the container in communication with the second fluid 18, preferably water, therein. The fluid storage container 120 has a hanging rope 121 or other means to make it capable of being hung up, as over a tree branch 17, and the shower spout 122 capable of dispensing the heated second fluid 18 in the form of a shower spray.

The entire system is capable of being drained to empty all of the fluid therefrom for ease of transport.

The invention may be used as both an outdoor heating and cooling system for alternately exposing the fluid to a heat source and a cooling source and distributing the fluid to a variety of items normally used outdoors.

The same heating pod 20 may also be used as a cooling pod 20, so that it is actually a combined heating and cooling system. The container 24 is capable of absorbing both heat and cold. The container holds a first fluid 16 therein, which may be water, snow, ice, or other fluids or various states of water. The heat exchange means, preferably coil 21, within the container, is capable of being immersed in the first fluid to alternately absorb heat and cold from the first fluid depending on the desired application whether the weather conditions are cold or hot. The heat exchange means, coil 21, is capable of absorbing both heat and cold from the first fluid 16 and transmitting it to the second fluid 18 therein for circulation through the system by the pump 35. The second fluid in the flexible tubing 40–47 is capable of transmitting both heat and cold to the various outdoor items as desired.

In operation, it is preferable the system is used with adult or responsible supervision. The operation is basically simple. The heating pod 20 should be placed flatly on the fire, grill or stand as stable as possible because it will burn downward (with gravity) in the fire. An optional grill or stand 29 can be used for increased stability. Thorough instructions on proper placement of unit on fire or stand will make it possible for unit to deliver heat for many hours. If a stand were used, it would allow better aeration to fire directly under pod unit.

Variations of the grill or stand to include all types, models, and materials. For best results, the unit should be used flat; and given ample time ½–1 hour to function efficiently. The system capitalizes on the heat capacitance and transfer properties of water. Not to mention the abundance of water in certain areas. But whether water is available or not the system doesn't require overly large amounts of water. The system should be drained of water when not in use to be transported.

The heating pod can be placed directly on the fire or heat element. Water(used in ballast systems) is stable when placed appropriately. The pod or stand base of support should be placed carefully in the fire with consideration of plastic tubing at the end of copper tubing and balance so the pod burns down stable with gravity. It is recommended that the flames do not go over the top of the heating container 24 so the tubing 40 will not melt. Fire will further heat the system by heating the horizontal metal tube ends 22 out of the top of heating pod. The metal tubes should be directed away from the fire.

Gravity will work against the pump, so it is preferable to put system on a flat level surface. All types of fuels-such as butane, gasoline, kerosene, propane, Sterno, diesel, or other fuels can heat the pod, but the preferred method is wood or anything that will burn including solid fuels. This invention is inclusive of all fuels listed and not listed here. Not only is the pod to be used on fires outdoors, but all other heat systems, such as a mini stove, hibachi, barbecue, fire place or heating coils over fire without a pod cover and this system includes all other heating elements not mentioned here.

The closer the pod unit is or the shorter the tubing is to the element to be heated, the more beneficial the heat transfer. The system will still transfer heat 20 feet to the element to be heated with good result.

Water is just one of all types of fluids that can be used. Water is used as an example due to its favorable chemical properties and abundance. As mentioned before, snow can also be used and will melt to water in the heating pod. Water 16 will be heated in the heating pod 20. Water should cover the coils 21 which will in turn heat them and the water inside the coils. The water in the coils is pushed through the system to the tubing 40–47. The water pump 35 through centrifugal action will push water through the system to the heating pod via the tubing because there is a finite space. By displacement, the water will be pushed to the item to be heated back to the reservoir to be recirculated.

Because water is able to deliver adequate heat, it is only necessary for the unit to deliver a bolus of hot water one minute out of every 5 minutes and at variable settings of the timer. This will also save on battery capacity. Heating coils or tubing sewn in the fabric of the system item(s) to be heated is not exclusive to a sleeping bag, heater or tent but can be modified to include a portable lightweight chair, cot, couch, lounger of any size, shape, model, material to be heated. This is inclusive to all other elements to be heated and not only to these mentioned.

The variability of how often the timer goes on is directly proportional to the desired heat delivered. The graduation 36 on the reservoir will monitor water that is used up or the necessity to add water. So retrospectively, here is a chronological function of the system: Heat source>Pod shell>Water>Metal tube>Water>Tubing>Heated element>Tubing>Reservoir/Water pump>Tubing>Pod.

The water 18 is carried to different parts of the system via the tubing 40–47, owing to the water pump 35 being intermittently started by the adjustable timer 34. Through experimentation, it is shown the heat is retrained in the system and heat transfer is remarkably adequate. The longer the system runs the closer the temperature of the heated element approaches the temperature of the water of the pod. This shows the favorable conservation of heat (temperature) of the system and can be proven experimentally.

The system can cut heating costs and deliver heat effectively. The system can also be used indoors; anywhere there is a fire or other source of heat (or cold). The invention serves as an effective, possibly life saving, backup emergency heating or cooling system in the home. During power outages, which often occur in extremes of hot or cold weather, the system may be used on a gas stove, fireplace, or other home heat source for maintaining comfort against the cold and alternately using cold water cooled further with ice or just circulated in the system as a cooling means.

The system can be powered by wind, solar or hydroelectric. Secondary applications of the system are numerous. Because heated tubing acts as a beacon giving off an infrared heat signature as long as a plane or satellite has line of sight and heat jacket isn't on the tubing.

In cases of hypothermia, the system can be used to quickly elevate the body temperature. The coils in the pod can be laid directly on the heat source to give instant, direct heat. The system will reduce incidence of gangrene and frostbite.

The system can also be used in severe heat exhaustion. Just fill the pod with ice and water, run the system to cool individual (obviously not using the heat source).

If a power source such as wind or solar are used, heat can be transferred extremely economically and efficiently. Wind power ca n be used at all times and the pump can run whenever the wind generator is functioning. Wind and solar can also be used to store battery energy.

In FIG. 7, the shower reservoir 120 will closely resemble the reservoir 30 in function. The shower reservoir 120 will be a lightweight plastic or other material box with waterproof liner and can be assembled easily. All components can be carried within a fixed reservoir (if the reservoir is fixed). The shower reservoir will be of greater capacity volume. The shower reservoir pump 35 will include a greater output pump to overcome gravity and a faster circulation rate of fluid. The unit will be hung aloft by a branch 17 or placed on an elevated position so the water in the reservoir can work by water pump and gravity.

The pump 35 on the shower reservoir will function on an on/off switch and work intermittently or continuously to obtain the desired heat. It is preferential the pump is run 5–10 minutes before hand to obtain the desired temperature. Water in the reservoir will be pumped down and by water pump ejection and gravity providing adequate kinetic energy to return back to the reservoir. The water will slow slightly from its turbulent flow in the coils.

A small tube 40 from the heating pod 20 to the shower reservoir 120 can guarantee more consistent flow if gravity is a problem or a larger tube from the shower reservoir 120 to the heating pod 20 to obtain a greater pressure to overcome gravity to return to the heating pod.

The shower head 122 can be of any material and fold out from the shower reservoir 120. The shower head and stem can be of any shape, size or material, such as plastic. A pull ring 123 can be used to open the shower head flow.

Figure 4:
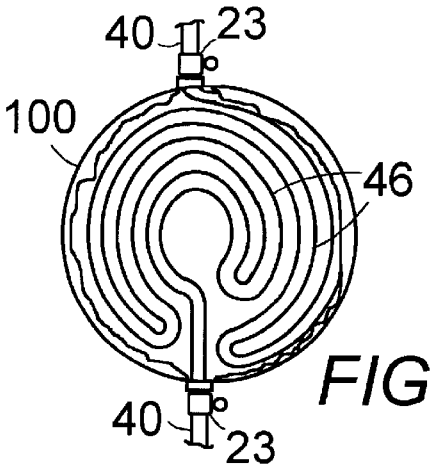
FIG. 4 is a top plan view in partial section of a bowl having the loop of tubing incorporated in the structure for circulating heated or cooled fluid therethrough.
Figure 5:
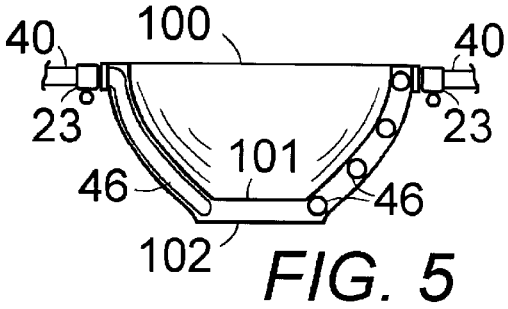
FIG. 5 is a cross-sectional view of the bowl of FIG. 4 taken through 5—5.
Figure 6:
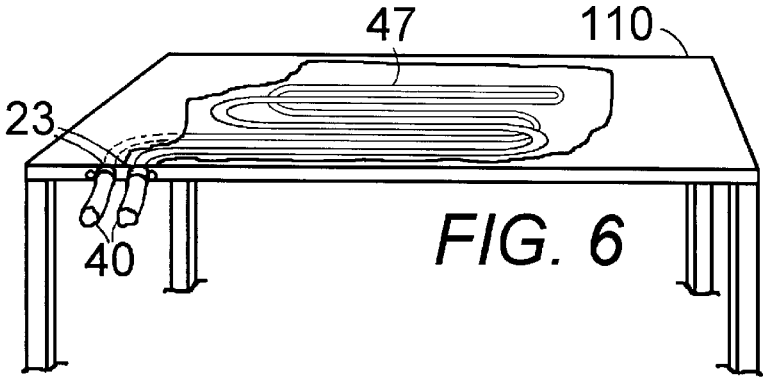
FIG. 6 is a perspective view in partial section showing a portable operating table having the loop of tubing incorporated in the structure for circulating heated fluid therethrough to warm the patient.

In FIGS. 4 and 5, a heating bowl 100 of variable shape, size, volume, material can be placed in line anywhere in the system. The bowl is connected by clamps 23 as the other components are. The heating bowl will be double walled 101, 102 with tubing 46 in between walls 101, 102 to heat water, food or other things placed in the bowl. The bowl can be used to melt ice, as a hand wash, cook food, etc. The tubing 46 in the bowl walls will transfer heat to whatever is in the bowl.

For a hot tub or bath outdoors, dig a hole, cover it with waterproof material and fill it with water. Place the pump in the hot tub (not to be disturbed). Pump water out of the tub to the heating pod (a safe distance away) and back to hot tub. This sort of invention will redefine the term "roughing it".

To clear ice from a given area, place pump below the water line to be sure of constant water flow. Pump water to the pod with the exiting tube from the pod open ended so hot water will contact the ice and melt it. Run off can be recirculated.

MATERIALS USED AND SCIENTIFIC DATA

The materials used in the invention are the best for their purpose. Their physical properties and characteristics show theoretically and experimentally their value. Research and development has shown that the temperature of the items to be heated comes closer to the pod temperature in time, demonstrating the efficiency of the system. The longer the system functions, the more efficient it is with a good water source. Disregarding the sleeping bag, tent or heater. Also disregarding the water pump, power source and timer, citing only the actual pod and tubing, the primary materials used in the invention are copper (Cu), Al (Al) and polyvinyl tubing. Cited is the standard apparatus experimented with, but other materials may be substituted. Some materials may actually exist as alloys, which will change their physical properties. Polyvinyl tubing is pliable, lightweight and non-breakable. It will retain and transfer heat well. Presented are some materials used and their characteristics.

| Value | Units | Al | Cu | H2O(liq.) | H2O(gas) |
|---|---|---|---|---|---|
| Melting Point | C. | 660.1 | 1084.5 | | |
| Thermal Conductivity | | 2.37 | 4.01 | | |
| Heat Capacitance: | | 24.34 | 24.47 | 75.30 | |
| ΔH | kJ | | | −285.84 | −241.83 |

Al and Cu are thermodynamically stable and copper breaks down in aqueous regia. Al starts to melt at about 600°. The direction of the heat flow and transfer is as follows:

Fire (heat)>Pod (Al, Fe, whatever heat resistant material) >H20 in pod>Cu in coils>H20 in coils>Polyvinyl tubing>Heated element>Reservoir>Back to pod.

As shown by standard values (according to CRC handbook), the materials have high heat transfer, capacitance and some indiscernible expansion when heated. Since water has a high capacitance, it will sufficiently transfer and retain heat through the system to the individual.

The pump will move water freely through the system, as shown by experimentation, heat will be returned in the system until a constant temperature is reached. All this is proven in the Research Data section.

Some basic scientific formulas and considerations are as follows: The ΔH from H20 (g) to H20 (1) is significant—showing the potential of the system. The kinetics of the system starts at the pod-heat source and efficiently transfer heat to the rest of the system. The system chemically is strongly exothermic (giving off heat). The system has a feint enclosed space and therefore is controllable harnessing a great deal of the generated heat. As the pressure rises in the system, so does temperature.

$$PV=nRT;$$

The ideal Gas Law

Water will transfer heat efficiently to the coils back to water and then to the tubing.

It is understood that the preceding description is given merely by way of illustration and not in limitation of the invention and that various modifications may be made thereto without departing from the spirit of the invention as claimed.

What is claimed is:

1. An outdoor/indoor heating system for taking heat from a heat source and distributing the heat to a variety of camping and survival items, the system comprising:

a heat pod having a heating container capable of absorbing heat and capable of holding a first fluid therein and a heat exchange means within the heating container, the heat exchange means capable of being immersed in the first fluid to absorb heat from the first fluid, the heat exchange means having an interior opening therethrough capable of having a second fluid flow through the interior opening, the second fluid capable of absorbing heat from the heat exchange means;

a conduit means capable of receiving the second fluid from the heat exchange means and distributing the second fluid through at least one of the items to transmit heat to the at least one item, and recirculating the second fluid back through the heat exchange means in a continuously recirculating cycle of heating and distributing the second fluid;

a pump means capable of pumping the second fluid through the conduit means and the heat exchange means;

wherein the conduit means comprises a series of flexible tubes interconnected, with at least one of the series of flexible tubes inserted in the at least one item.

2. The system of claim 1 wherein the first fluid and the second fluid are water.

3. The system of claim 1 wherein the first fluid is air and the second fluid is water.

4. The system of claim 1 wherein the heat exchange means comprises a coil having a hollow interior throughout the length of the coil.

5. The system of claim 1 wherein the heat exchange means has at least one outflow end and at least one inflow end, the ends communicating with the interior opening of the heat exchange means, and the conduit means comprises at least one flexible tube attached to the at least one outflow end of the heat transfer means and extending through the at least one item and attached to the at least one inflow end of the heat transfer means and the at least one flexible tube communicating with the pump means, so that the at least one flexible tube forms, with the interior opening of the heat exchange means, a continuous loop for circulating the second fluid therethrough, the second fluid being circulated by the pump means.

6. The system of claim 1 wherein the at least one of the flexible tubes is built into the at least one item forming a loop therein, the loop having two ends each attached to a clamp, the clamp being capable of clamping an end of an exterior flexible tube.

7. The system of claim 1 wherein the pump means comprises a fluid storage container, containing the second fluid and having a pump positioned therein in communication with the second fluid, the pump being capable of pumping the second fluid through the system.

8. The system of claim 1 wherein the pump is formed of synthetic material and powered by a battery.

9. The system of claim 1 wherein the at least one item consists of at least one item selected from the group of items consisting of a sleeping bag, a tent, a heater, a chair, a bowl, and an operating table.

10. The system of claim 1 wherein the entire system is capable of being drained to empty all of the fluid therefrom for ease of transport.

11. An outdoor/indoor heating system for taking heat from a heat source and distributing the heat to a variety of camping and survival items, the system comprising:

a heat pod having a heating container capable of absorbing heat and capable of holding a first fluid therein and a heat exchange means within the heating container, the heat exchange means capable of being immersed in the first fluid to absorb heat from the first fluid, the heat exchange means having an interior opening therethrough capable of having a second fluid flow through the interior opening, the second fluid capable of absorbing heat from the heat exchange means;

a conduit means capable of receiving the second fluid from the heat exchange means and distributing the second fluid through at least one of the items to transmit heat to the at least one item, and recirculating the second fluid back through the heat exchange means in a continuously recirculating cycle of heating and distributing the second fluid;

a pump means capable of pumping the second fluid through the conduit means and the heat exchange means;

wherein the heat exchange means comprises a coil having a hollow interior throughout the length of the coil;

wherein the coil is fabricated of a noncombustible rigid material capable of transferring heat to the fluid flowing through the coil, the coil having at least one outflow elongated end and at least one inflow elongated end, the elongated ends extending beyond the heat source.

12. An outdoor/indoor heating system for taking heat from a heat source and distributing the heat to a variety of camping and survival items, the system comprising:

a heat pod having a heating container capable of absorbing heat and capable of holding a first fluid therein and a heat exchange means within the heating container, the heat exchange means capable of being immersed in the first fluid to absorb heat from the first fluid, the heat exchange means having an interior opening therethrough capable of having a second fluid flow through the interior opening, the second fluid capable of absorbing heat from the heat exchange means;

a conduit means capable of receiving the second fluid from the heat exchange means and distributing the second fluid through at least one of the items to transmit heat to the at least one item, and recirculating the second fluid back through the heat exchange means in a continuously recirculating cycle of heating and distributing the second fluid;

a pump means capable of pumping the second fluid through the conduit means and the heat exchange means;

wherein the heat exchange means has at least one outflow end and at least one inflow end, the ends communicating with the interior opening of the heat exchange means, and the conduit means comprises at least one flexible tube attached to the at least one outflow end of the heat transfer means and extending through the at least one item and attached to the at least one inflow end of the heat transfer means and the at least one flexible tube communicating with the pump means, so that the at least one flexible tube forms, with the interior opening of the heat exchange means, a continuous loop for circulating the second fluid therethrough, the second fluid being circulated by the pump means; wherein the flexible tube is capable of being inserted in a number of the items by inserting a loop of the flexible tube into each of the items.

13. An outdoor/indoor heating system for taking heat from a heat source and distributing the heat to a variety of camping and survival items, the system comprising:

a heat pod having a heating container capable of absorbing heat and capable of holding a first fluid therein and a heat exchange means within the heating container, the heat exchange means capable of being immersed in the first fluid to absorb heat from the first fluid, the heat exchange means having an interior opening therethrough capable of having a second fluid flow through the interior opening, the second fluid capable of absorbing heat from the heat exchange means;

a conduit means capable of receiving the second fluid from the heat exchange means and distributing the second fluid through at least one of the items to transmit heat to the at least one item, and recirculating the second fluid back through the heat exchange means in a continuously recirculating cycle of heating and distributing the second fluid;

a pump means capable of pumping the second fluid through the conduit means and the heat exchange means;

a timer for controlling the pump means, the timer being capable of operating the pump in timed intervals;

wherein the pump means comprises a fluid storage container, containing the second fluid and having a pump positioned therein in communication with the second fluid, the pump being capable of pumping the second fluid through the system.

14. An outdoor/indoor heating system for taking heat from a heat source and distributing the heat to a variety of camping and survival items, the system comprising:

a heat pod having a heating container capable of absorbing heat and capable of holding a first fluid therein and a heat exchange means within the heating container, the heat exchange means capable of being immersed in the first fluid to absorb heat from the first fluid, the heat exchange means having an interior opening therethrough capable of having a second fluid flow through the interior opening, the second fluid capable of absorbing heat from the heat exchange means;

a conduit means capable of receiving the second fluid from the heat exchange means and distributing the second fluid through at least one of the items to transmit heat to the at least one item, and recirculating the second fluid back through the heat exchange means in a continuously recirculating cycle of heating and distributing the second fluid;

a pump means capable of pumping the second fluid through the conduit means and the heat exchange means, wherein the pump is formed of synthetic material and powered by a battery;

a wind powered generator for generating electricity to add power to the system;

wherein the pump means comprises a fluid storage container, containing the second fluid and having a pump positioned therein in communication with the second fluid, the pump being capable of pumping the second fluid through the system.

15. An outdoor/indoor heating system for taking heat from a heat source and distributing the heat to a variety of items, the system comprising:

a heat pod having a heating container capable of absorbing heat and capable of holding a first fluid therein and a heat exchange means within the heating container, the heat exchange means capable of being immersed in the first fluid to absorb heat from the first fluid, the heat exchange means having an interior opening therethrough capable of having a second fluid flow through the interior opening, the second fluid capable of absorbing heat from the heat exchange means;

a conduit means capable of receiving the second fluid from the heat exchange means and distributing the second fluid through at least one of the items to transmit heat to the at least one item, and recirculating the second fluid back through the heat exchange means in a continuously recirculating cycle of heating and distributing the second fluid;

a pump means capable of pumping the second fluid through the conduit means and the heat exchange means;

wherein the pump means comprises a fluid storage container, containing the second fluid and having a pump positioned therein in communication with the second fluid, the pump being capable of pumping the second fluid through the system;

wherein the fluid storage container further comprises a shower spout attached thereto in communication with the second fluid therein, the fluid storage container capable of being hung up and the shower spout capable of dispensing the heated second fluid in the form of a shower spray.

16. An outdoor/indoor heating system for taking heat from a heat source and distributing the heat to a variety of camping and survival items, the system comprising:

a heat pod having a heating container capable of absorbing heat and capable of holding a first fluid therein and a heat exchange means within the heating container, the heat exchange means capable of being immersed in the first fluid to absorb heat from the first fluid, the heat exchange means having an interior opening therethrough capable of having a second fluid flow through the interior opening, the second fluid capable of absorbing heat from the heat exchange means;

a conduit means capable of receiving the second fluid from the heat exchange means and distributing the second fluid through at least one of the items to transmit heat to the at least one item, and recirculating the second fluid back through the heat exchange means in a continuously recirculating cycle of heating and distributing the second fluid;

a pump means capable of pumping the second fluid through the conduit means and the heat exchange means;

a second container placed above the heating container and in communication with the heating container, the second container being capable of holding ice and snow therein and capable of transmitting heat from the heating container to the snow and ice contained therein so that the ice and snow will melt into water and the second container is capable of transmitting the water to the heating container.

17. An outdoor/indoor heating system for taking heat from a heat source and distributing the heat to a variety of camping and survival items, the system comprising:

a heat pod having a heating container capable of absorbing heat and capable of holding a first fluid therein and a heat exchange means within the heating container, the heat exchange means capable of being immersed in the first fluid to absorb heat from the first fluid, the heat exchange means having an interior opening therethrough capable of having a second fluid flow through the interior opening, the second fluid capable of absorbing heat from the heat exchange means;

a conduit means capable of receiving the second fluid from the heat exchange means and distributing the second fluid through at least one of the items to transmit heat to the at least one item, and recirculating the second fluid back through the heat exchange means in a continuously recirculating cycle of heating and distributing the second fluid;

a pump means capable of pumping the second fluid through the conduit means and the heat exchange means; and a stand for the heating container, the stand capable of supporting the heating container directly over the campfire and capable of positioning the heating container in contact with the heat from the campfire as the campfire burns down.

18. An outdoor/indoor heating and cooling system for alternately exposing a fluid to a heat source and a cooling source and distributing the fluid to a variety of camping and survival items, the system comprising:

a heating and cooling pod having a container capable of absorbing heat and cold, the container being capable of holding a first fluid therein and a heat exchange means within the container, the heat exchange means capable of being immersed in the first fluid to alternately absorb heat and cold from the first fluid, the heat exchange means having an interior opening therethrough capable of having a second fluid flow through the interior opening, the second fluid capable of absorbing heat and cold from the heat exchange means;

a conduit means capable of receiving the second fluid from the heat exchange means and distributing the second fluid through at least one of the items to transmit alternately heat and cold to the at least one item, and recirculating the second fluid back through the heat exchange means in a continuously recirculating cycle of heating and distributing the second fluid and alternately cooling and distributing the second fluid;

a pump means capable of pumping the second fluid through the conduit means and the heat exchange means;

wherein the conduit means comprises a series of flexible tubes interconnected, with at least one of the series of flexible tubes inserted in the at least one item.

19. An outdoor/indoor heating system for taking heat from a heat source and distributing the heat to a variety of camping and survival items, the system comprising:

a heat exchange means capable of being exposed directly to an external heat source, the heat exchange means having an interior opening therethrough capable of having a fluid flow through the interior opening, the fluid being capable of absorbing heat from the heat exchange means;

a conduit means capable of receiving the fluid from the heat exchange means and distributing the fluid through at least one of the items to transmit heat to the at least one item, and recirculating the fluid back through the heat exchange means in a cycle of heating and distributing the fluid;

a pump means capable of pumping the fluid through the conduit means and the heat exchange means;

a timer means connected to the pump means, the timer means being capable of controlling the pump means so that the pump operates in timed intervals.

20. The system of claim 19 wherein the conduit means comprises a series of flexible tubes interconnected, with at least one of the series of flexible tubes inserted in the at least one item.

* * * * *